US009233541B1

(12) United States Patent
Cyr et al.

(10) Patent No.: US 9,233,541 B1
(45) Date of Patent: Jan. 12, 2016

(54) PRINTHEAD MAINTENANCE STATION FOR SCALABLE PRINTHEAD ARRAYS

(71) Applicant: Xerox Corporation, Norwalk, CT (US)

(72) Inventors: Brian C. Cyr, Penfield, NY (US); Jorge M. Rodriguez, Webster, NY (US); Steven M. Russel, Bloomfield, NY (US); Paul M. Fromm, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/708,637

(22) Filed: May 11, 2015

(51) Int. Cl.
*B41J 2/165* (2006.01)

(52) U.S. Cl.
CPC ..... *B41J 2/16523* (2013.01); *B41J 2/16585* (2013.01)

(58) Field of Classification Search
CPC ..... B41J 2/16523; B41J 2/16585
See application file for complete search history.

(56) References Cited

U.S. PATENT DOCUMENTS

| | | | | |
|---|---|---|---|---|
| 5,548,310 | A | 8/1996 | Binnert et al. | |
| 6,193,353 | B1 | 2/2001 | Vives et al. | |
| 6,343,850 | B1 | 2/2002 | Domagall | |
| 6,877,836 | B2 | 4/2005 | Wu | |
| 2006/0119644 | A1* | 6/2006 | Berry | B41J 2/16511 347/29 |
| 2006/0119646 | A1* | 6/2006 | Berry | B41J 2/16511 347/29 |
| 2006/0119657 | A1* | 6/2006 | Berry | B41J 2/16511 347/32 |
| 2006/0203030 | A1* | 9/2006 | Tobita | B41J 2/16585 347/22 |
| 2007/0002094 | A1* | 1/2007 | Kim | B41J 2/16535 347/33 |
| 2007/0040864 | A1* | 2/2007 | Jung | B41J 2/16585 347/22 |
| 2007/0263028 | A1* | 11/2007 | Zengo | B41J 2/16535 347/33 |
| 2008/0231655 | A1* | 9/2008 | Yamada | B41J 2/16585 347/30 |
| 2008/0231656 | A1* | 9/2008 | Kim | B41J 2/16511 347/33 |
| 2008/0246801 | A1* | 10/2008 | Carlson | B41J 2/16547 347/32 |
| 2009/0058921 | A1* | 3/2009 | Habashi | B41J 2/16585 347/29 |
| 2009/0122107 | A1* | 5/2009 | Ray | B41J 2/16585 347/37 |
| 2009/0289993 | A1* | 11/2009 | Yamaguchi | B41J 2/16585 347/33 |
| 2010/0091066 | A1* | 4/2010 | Lee | B41J 2/16535 347/28 |
| 2010/0123754 | A1* | 5/2010 | Lee | B41J 2/16585 347/32 |
| 2010/0171791 | A1* | 7/2010 | Turkenitz | B41J 2/16585 347/35 |

(Continued)

*Primary Examiner* — Julian Huffman
(74) *Attorney, Agent, or Firm* — Maginot Moore & Beck LLP

(57) ABSTRACT

A printing system includes a maintenance device that is configured to correspond to different configurations of a scalable printhead array. The printing system includes a first printhead array having a plurality of printheads and a pair of frames disposed in parallel and on opposite ends of the first printhead array. A first maintenance platform is mounted between the pair of frames and configured move from a first position at a first side of the first printhead array to a second position opposite faces of the printheads in the first printhead array. The first maintenance platform is configured to perform a maintenance operation on the plurality of printheads of the first printhead array when the platform is at the second position, and a first actuator is configured to move the first maintenance platform between the first position at the first side of the printhead array and the second position.

14 Claims, 14 Drawing Sheets

(56) References Cited

U.S. PATENT DOCUMENTS

2010/0201738 A1* 8/2010 Yamaguchi ..... B41J 2/16585 347/31
2010/0201739 A1* 8/2010 Yamaguchi ..... B41J 2/16511 347/32
2011/0279536 A1 11/2011 Love et al.
2011/0279538 A1 11/2011 Love et al.
2012/0200636 A1* 8/2012 Frazier ..... B41J 2/16523 347/36
2013/0293633 A1* 11/2013 Li ..... B41J 2/16505 347/32

* cited by examiner

PRINTHEAD MAINTENANCE STATION FOR SCALABLE PRINTHEAD ARRAYS

TECHNICAL FIELD

The device and method disclosed in this document relates to inkjet printers and, more particularly, to maintenance of scalable inkjet printhead arrays.

BACKGROUND

Inkjet printing is a process of producing an image on a substrate, such as a sheet of paper. Inkjet printing is an additive process in which one or more printheads eject drops of ink onto the substrate to form the image on the substrate. The printheads are operated with reference to digital image data that represents the image to be printed. Printing a multicolored image generally requires at least one printhead for each color. Additionally, printing high resolution images often requires multiple printheads of the same color that are interlaced to provide the increased resolution. Accordingly, many inkjet printing systems comprise arrays of several printheads arranged in rows and columns.

FIG. 8 shows a prior art architecture for a scalable printhead array 800. The printhead array 800 includes a plurality of printhead assemblies 804. The printhead array 800 is configured to include a variable number of printhead assemblies 804 arranged into rows and columns in a variety of possible arrangements. As shown, the printhead array 800 is scalable up to 50" in width and includes up to fourteen printhead assemblies 804. Each printhead assembly 804 is configured to receive a printhead module 808 and to mount to frame 812 of the printhead array 800. FIG. 9 shows a more detailed view of one of the printhead assemblies 804 with a printhead module 808.

To ensure optimal performance of an inkjet printhead, the printheads must be well-maintained. Typically maintenance operations include purging, capping, and wiping. Prior art mechanisms for printhead maintenance are not easily adapted for scalable printhead arrays. Being able to configure a printhead maintenance system so it is easily scalable for use with a scalable printhead array would be beneficial.

SUMMARY

A printing system includes a printhead maintenance device configured to correspond to different configurations of a scalable printhead array. The printing system includes a first printhead array having a plurality of printheads; a pair of frames disposed in parallel and on opposite ends of the first printhead array; a first maintenance platform mounted between the pair of frames and configured to move from a first position at a first side of the first printhead array to a second position opposite faces of the plurality of printheads of the first printhead array to enable the first maintenance platform to perform a maintenance operation on the plurality of printheads of the first printhead array when the first maintenance platform is at the second position; and a first actuator configured to move the first maintenance platform between the first position and the second position.

BRIEF DESCRIPTION OF THE DRAWINGS

The foregoing aspects and other features of the printing system are explained in the following description, taken in connection with the accompanying drawings.

DETAILED DESCRIPTION

Figure 1A:
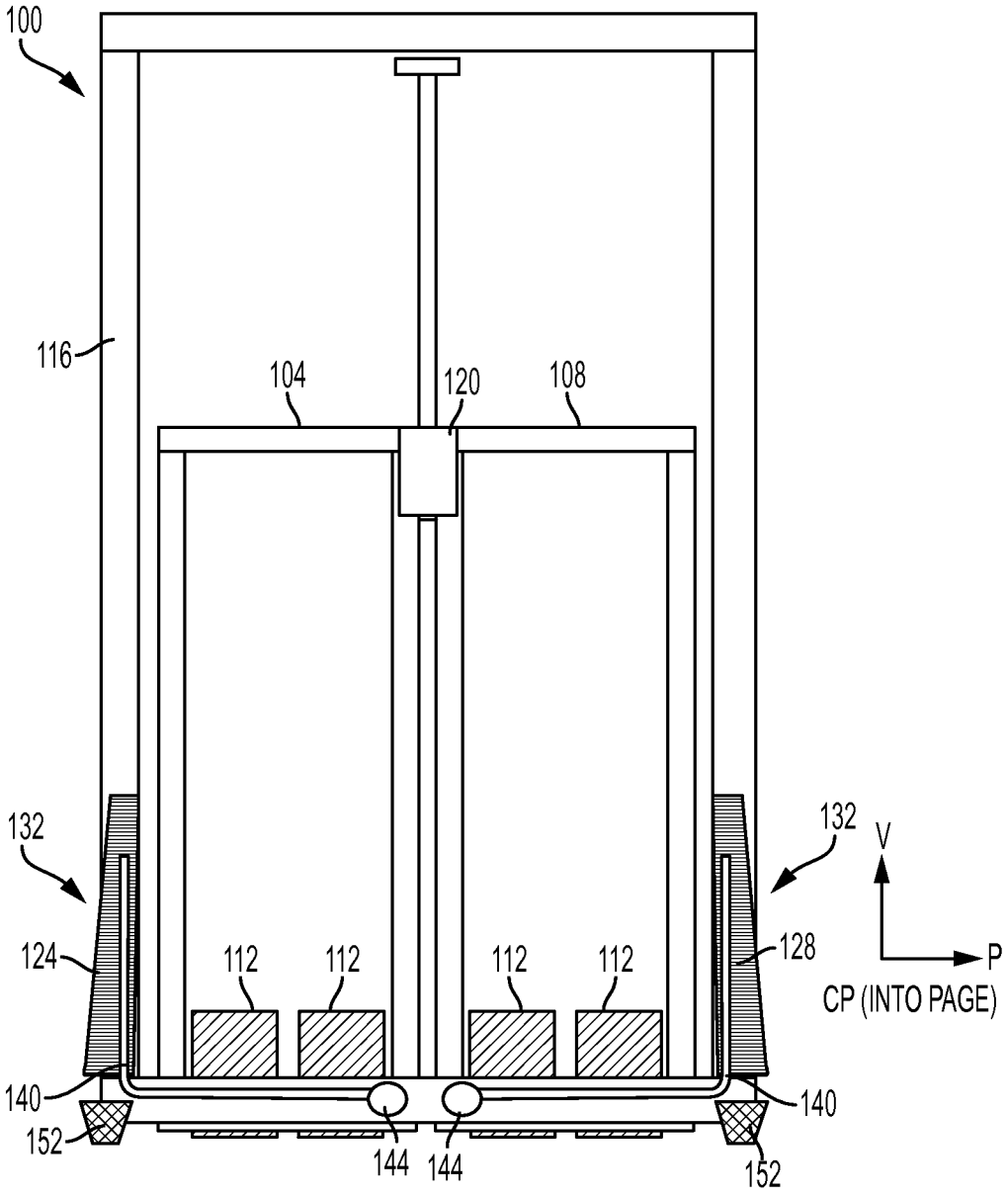
FIG. 1*a* shows a side view of a first embodiment of a printing system.

For a general understanding of the environment for the printing system disclosed herein as well as the details for the printing system, reference is made to the drawings. In the drawings, like reference numerals designate like elements.

Figure 1B:
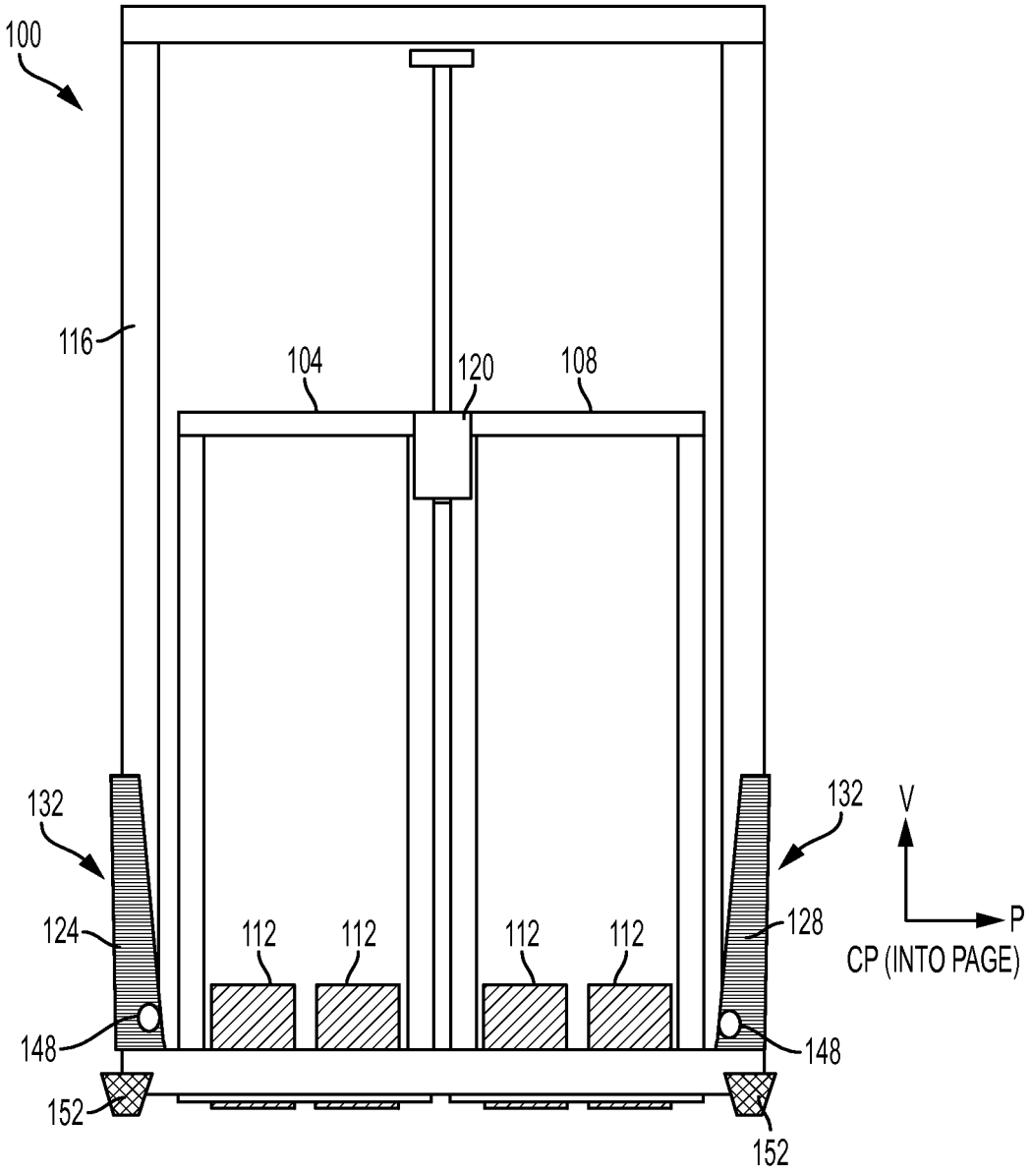
FIG. 1*b* shows a side view of a second embodiment of a printing system.

FIGS. 1*a* and 1*b* show a side view of a printing system 100. The printing system 100 has at least one printhead array, which is similar to the printhead array 800. In the embodiments shown in FIGS. 1*a* and 1*b*, the printing system 100 includes a first printhead array 104 and a second printhead array 108. The printhead arrays 104, 108 are arranged in parallel to one another such that the printhead arrays 104 print in series with one another. The printhead arrays 104, 108 each have a plurality of printhead assemblies 112, similar to the printhead assemblies 804. In the embodiments shown in FIGS. 1*a* and 1*b*, the printhead assemblies 112 of each printhead array 104, 108 are arranged in a configuration having two rows, each row having a variable number of printhead assemblies 112.

The printing system 100 includes a pair of frames 116 disposed in parallel to one another and on opposite ends of the printhead arrays 104. The frames 116 run parallel to the process direction P of the printhead arrays 104. In one embodiment, the frames 116 follow a "U" shaped path that runs down a side of the first printhead arrays 104 that is opposite the second printhead array 108, along the bottom of the printhead arrays 104, 108, and up a side of the second printhead array 108 that is opposite the first printhead array 104. In some embodiments, as shown in the figures, the printing system 100 includes an actuator 120 configured to move the printhead arrays 104, 108 up and down relative to the frames 116 in the vertical direction V. In other embodiments, the actuator 120 is configured to move the frames 116 relative to the printhead arrays 104, 108.

The printing system 100 includes a maintenance platform configured to perform maintenance operations on printheads of each printhead array. As shown in FIGS. 1*a* and 1*b*, the printing system 100 includes a first maintenance platform 124 for performing maintenance on the first printhead array 104 and a second maintenance platform 128 for performing maintenance on the second printhead array 108. The maintenance platforms 124, 128 are mounted between the frames 116 and configured to move between resting positions 132 and operating positions 136 (shown in FIGS. 4*a* and 4*b*) from which the maintenance platforms 124, 128 perform maintenance operations on the printheads of the printhead arrays 104, 108.

In the embodiment of FIG. 1*a*, tracks 140 are integrated into the frames 116. The maintenance platforms 124, 128 are configured to engage with the tracks 140 to move along the tracks 116 between their respective resting positions 132 and operating positions 136. Actuators 144 are operatively connected to the tracks 140 to move the maintenance platforms 124, 128 along the tracks 140. In one embodiment, the tracks 140 have chains (not shown) that engage with the maintenance platforms 124, 128 and the actuators 144 are electric motors configured to rotate and move the chains along the tracks 140 to convey the maintenance platforms 124, 128.

In the embodiment of FIG. 1*b*, the maintenance platforms 124, 128 are configured to pivot at one end to move between their respective resting positions 132 and operating positions 136. Actuators 148 are operatively connected to the maintenance platforms 124, 128 to pivot the maintenance platforms 124, 128. In one embodiment, the actuators 148 are electric motors configured to rotate and pivot the maintenance platforms 124, 128.

During normal printing operations, the printing system 100 is configured to move the printhead array 104, 108 down in the vertical direction such that the frames 116 do not obstruct the printhead arrays 104, 108 as they perform printing operations. The first maintenance platform 124 rests at the resting position 132 at the side of the first printhead array 104, opposite the second printhead array 108. Similarly, the second maintenance platform 128 rests at the resting position 132 at the side of the second printhead array 108, opposite the first printhead array 104. While in the resting positions 132, the maintenance platforms 124, 128 are oriented vertically, such that a narrowest dimension of the maintenance platform runs parallel to the process direction P. In this way, the maintenance platforms 124, 128 do not substantially enlarge the footprint of the printing system 100.

Figure 2A:
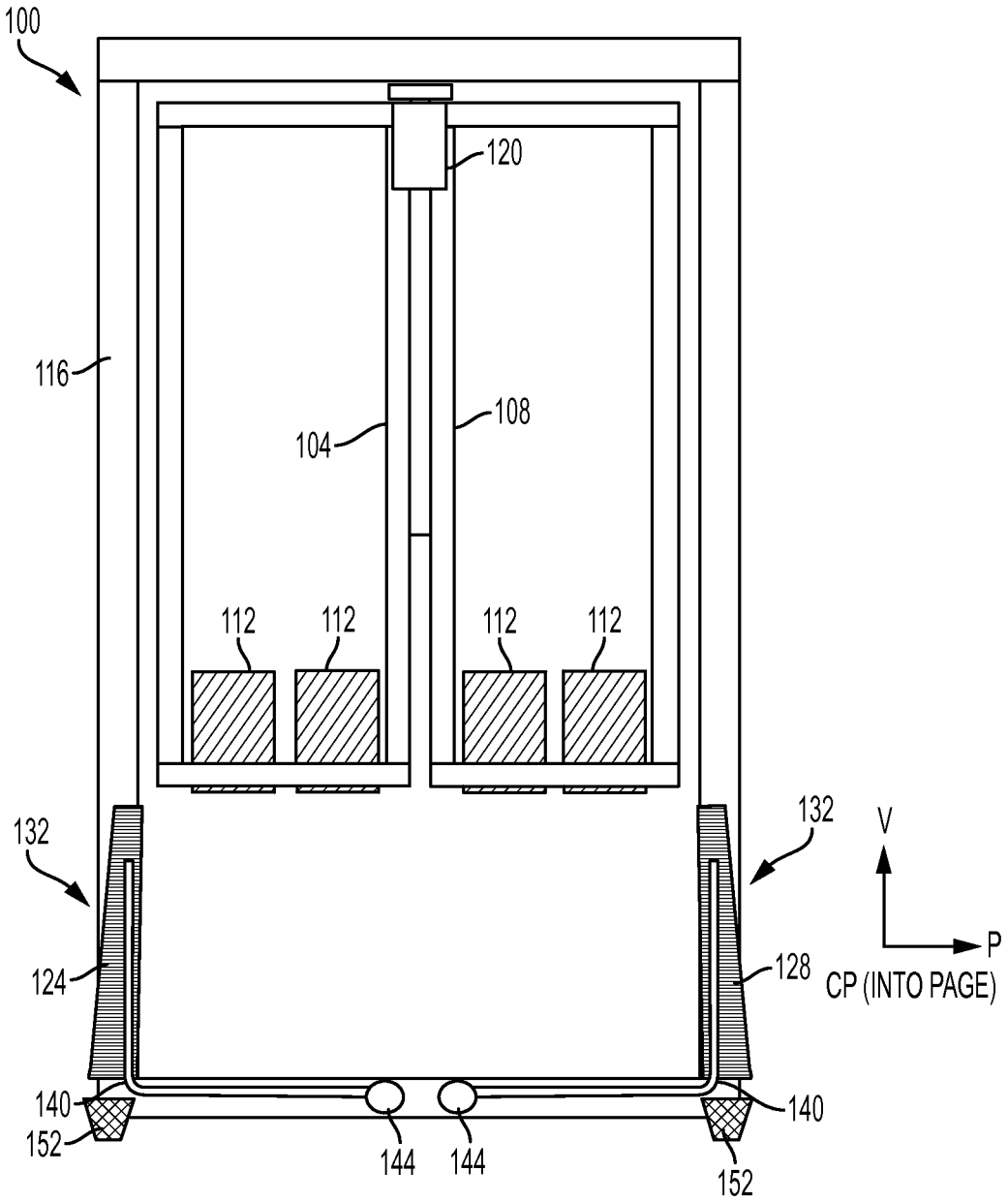
FIG. 2*a* shows the printing system of FIG. 1*a* with the printhead arrays raised.
Figure 2B:
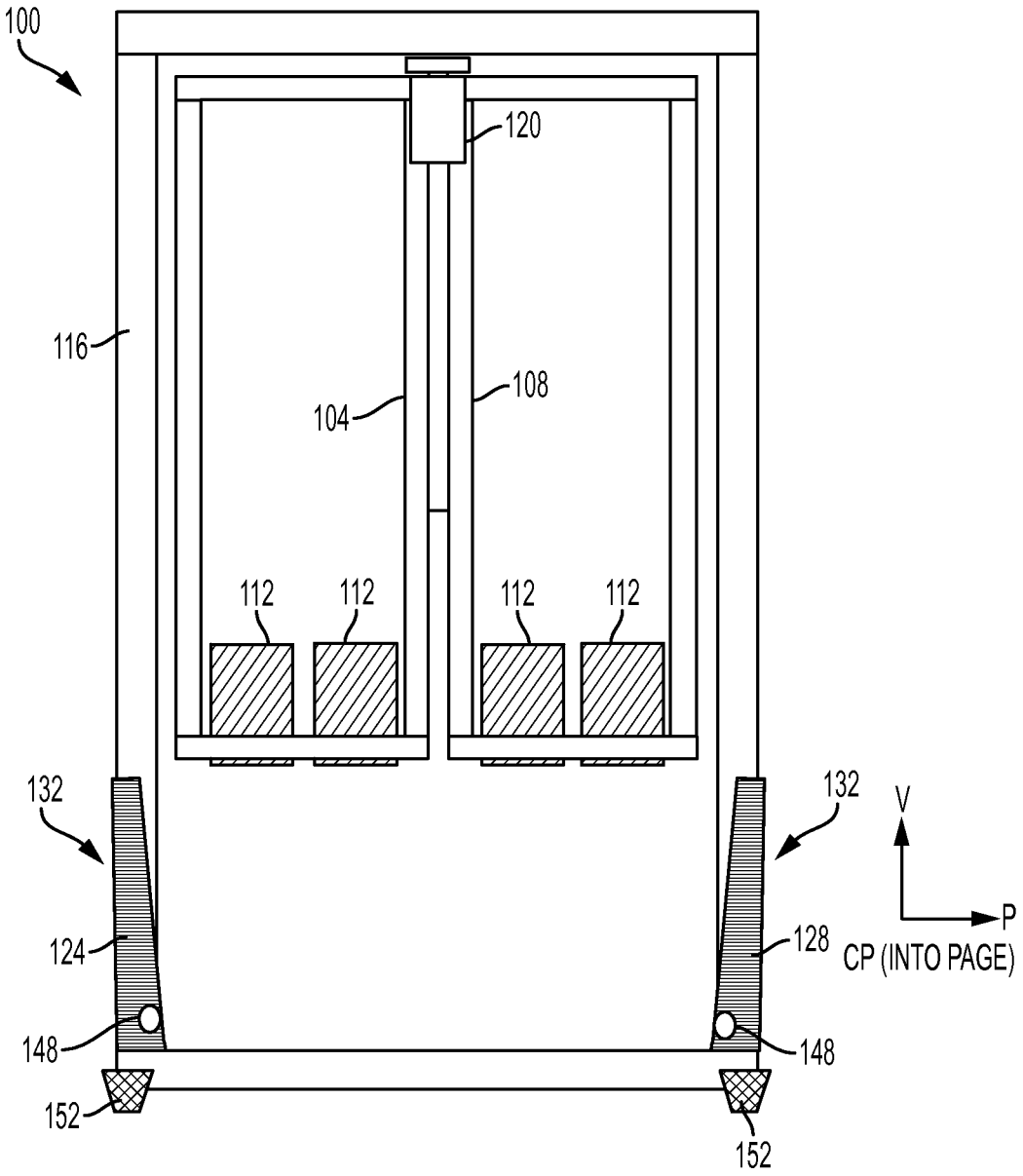
FIG. 2*b* shows the printing system of FIG. 1*b* with the printhead arrays raised.
Figure 3A:
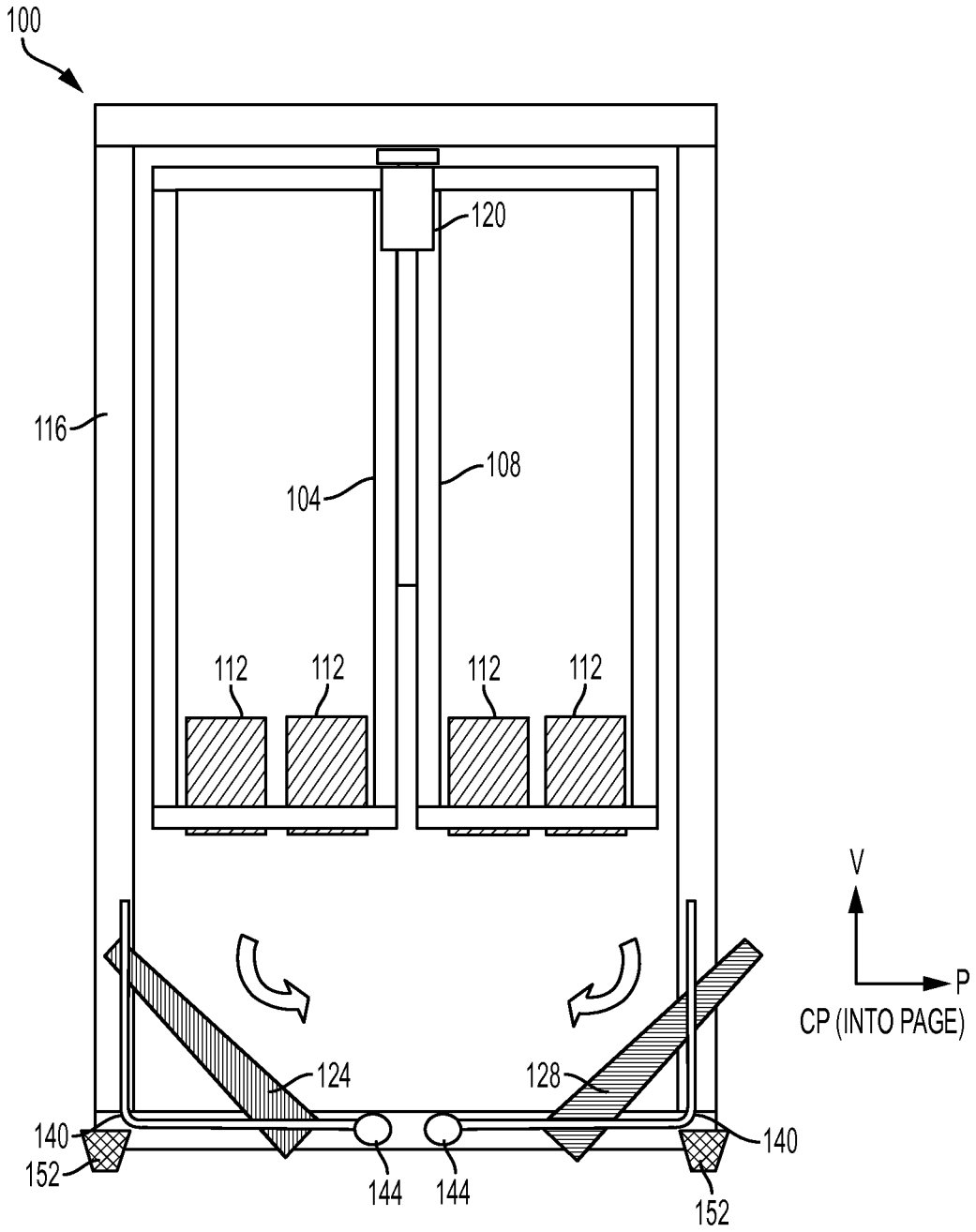
FIG. 3*a* shows the printing system of FIG. 1*a* with the maintenance platforms moving to an operating position.
Figure 3B:
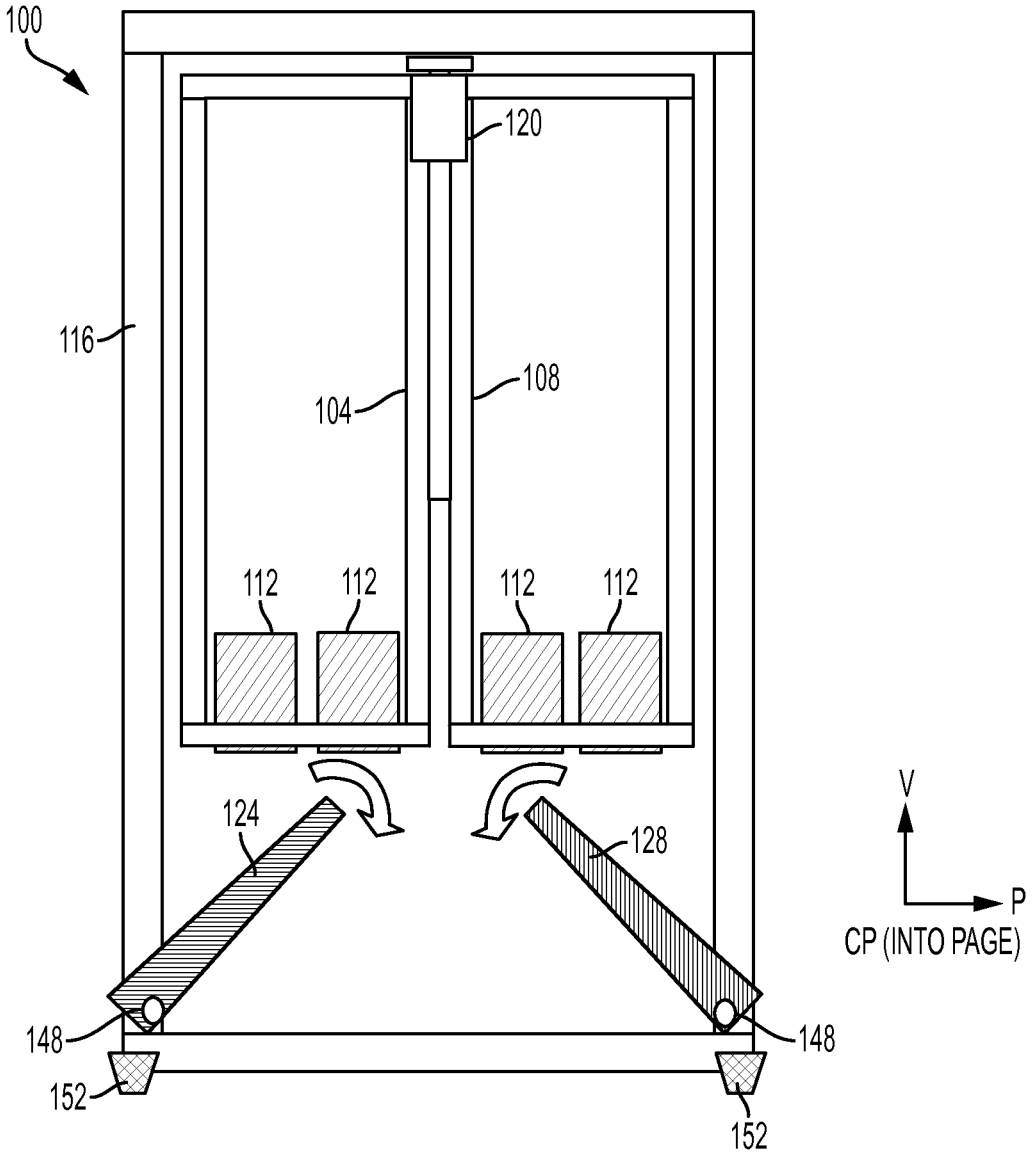
FIG. 3*b* shows the printing system of FIG. 1*b* with the maintenance platforms moving to an operating position.

When maintenance operations are performed, the actuator 120 moves the printhead arrays 104, 108 up in the vertical direction V to provide space between the printheads of the printhead arrays 104, 108 and the bottom portion of the frames 116, as shown in FIGS. 2*a* and 2*b*. Next, the maintenance platforms 124, 128 move from their respective resting positions 132 toward their respective operating positions 136. In the embodiment of FIG. 1*a*, the actuators 144 move the maintenance platforms 124, 128 along the track 140 toward their respective operating positions 136, as shown in FIG. 3*a*. Similarly, in the embodiment of FIG. 1*b*, the actuators 148 pivot the maintenance platforms 124, 128 toward their respective operation positions 136, as shown in FIG. 3*b*.

Figure 4A:
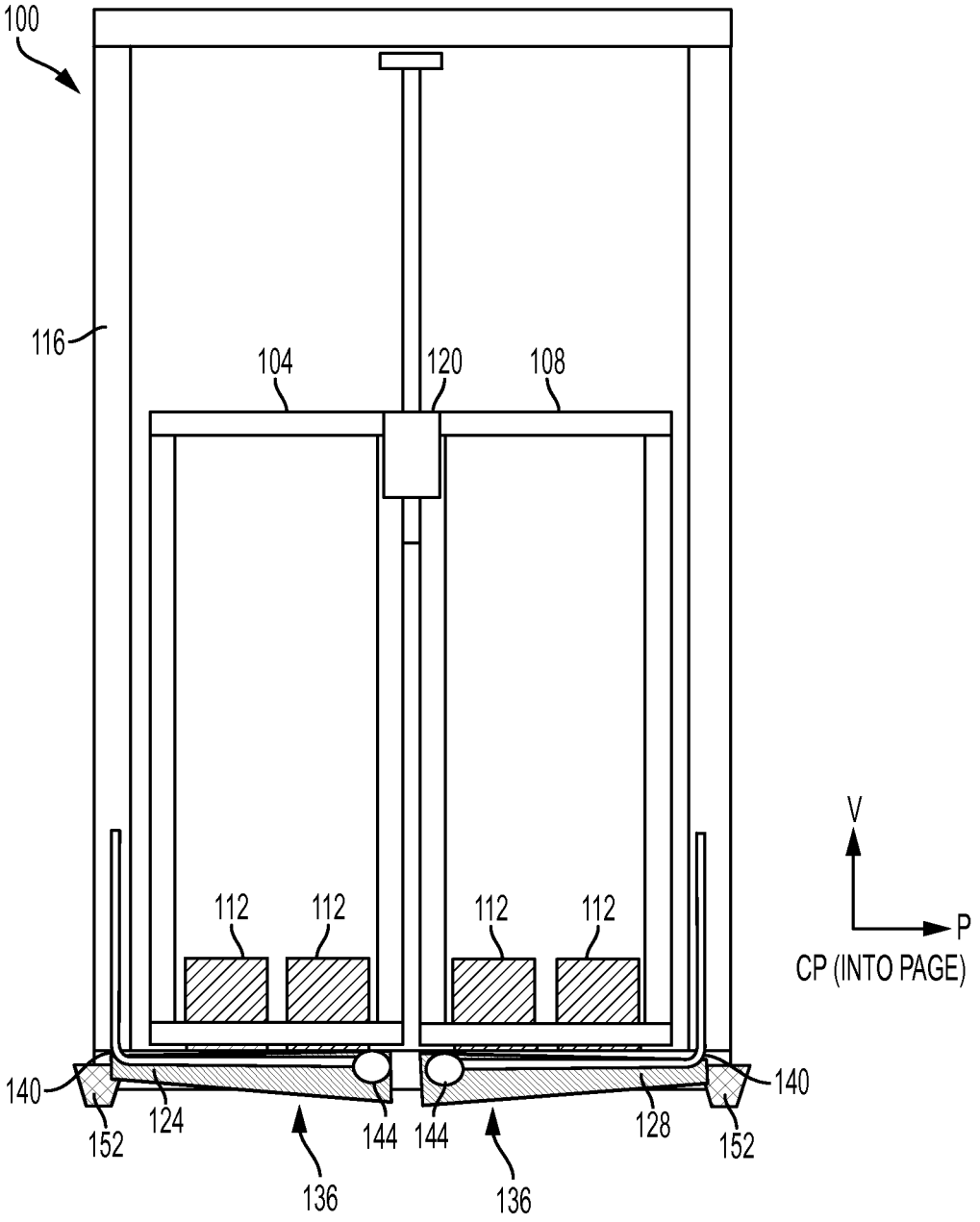
FIG. 4*a* shows the printing system of FIG. 1*a* with the maintenance platforms in an operating position and the printhead arrays lowered.
Figure 4B:
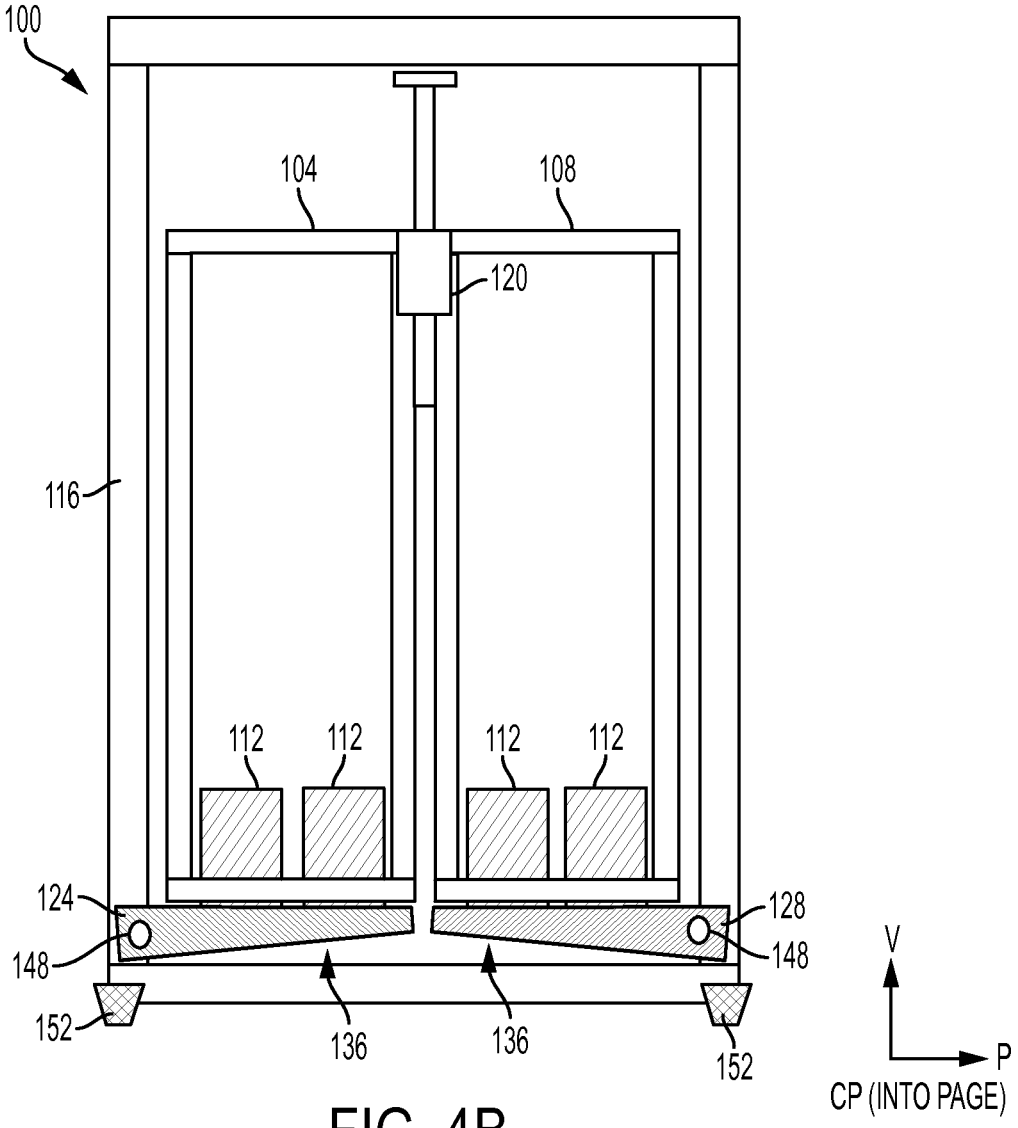
FIG. 4*b* shows the printing system of FIG. 1*b* with the maintenance platforms in an operating position and the printhead arrays lowered.

Once the maintenance platforms 124, 128 have moved to their respective operating positions 136, the actuator 120 moves the printhead arrays 104, 108 down in the vertical direction V, toward the maintenance platforms 124, 128. As shown in FIGS. 4*a* and 4*b*, the printhead arrays 104, 108 are positioned such that surfaces of the printheads of the printhead assemblies 112 are positioned near the maintenance platforms 124, 128 to enable maintenance operations to be performed on the printheads.

After maintenance operations are performed, the actuator 120 moves the printhead arrays 104, 108 up in the vertical direction V so that the maintenance platforms 124, 128 can return to their respective resting positions 132. When the maintenance platforms 124, 128 have returned to their respective resting positions 132, the actuator 120 moves the printhead arrays 104, 108 back down in the vertical direction V to enable printing operations to resume.

Figure 5A:
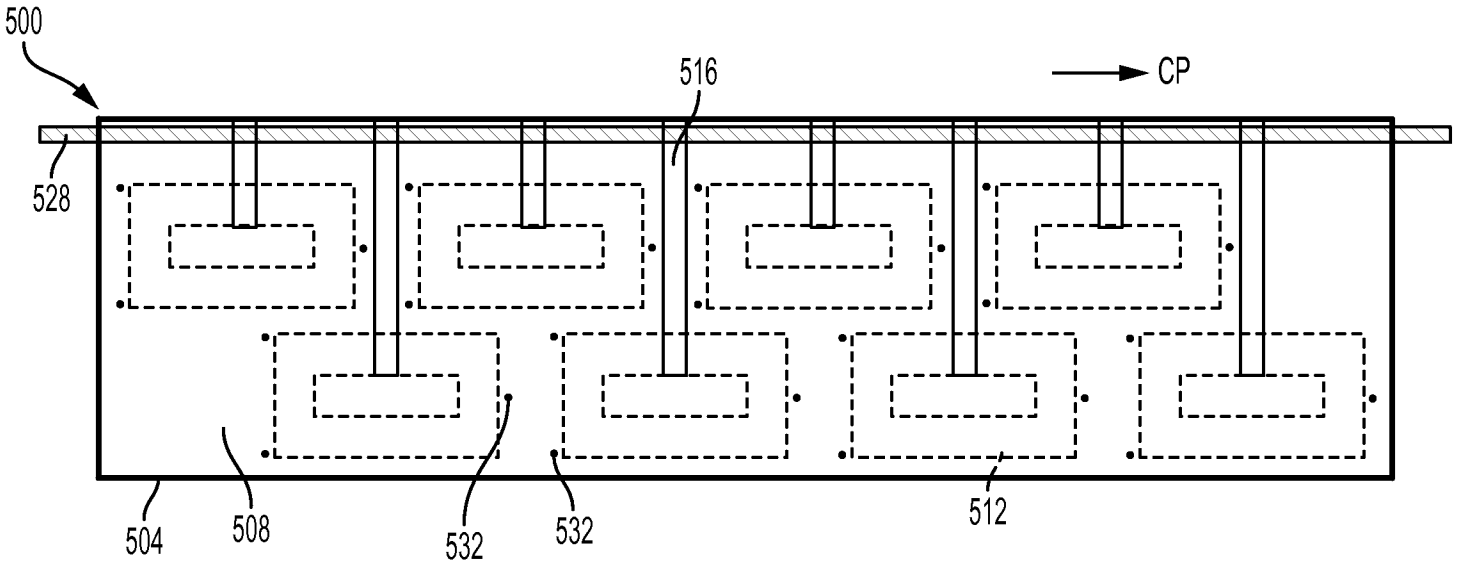
FIG. 5*a* shows a top view of a maintenance platform.

FIG. 5*a* shows a top view of a maintenance platform 500, which is one embodiment of the maintenance platforms 124, 128. The maintenance platform 500 has a body 504 with a generally planar top surface 508. The maintenance platform 500 has a plurality of sockets 512 in the surface 508. The sockets 512 are arranged in the surface 508 in a configuration that corresponds to a configuration of printhead assemblies in one of the printhead arrays 104, 108 such that, when the maintenance platform 500 is moved beneath the corresponding printhead array, the sockets 512 are aligned with the printhead assemblies 112 in a one-to-one correspondence. The sockets 512 are configured to receive maintenance modules that are configured to perform maintenance operations on a printhead.

Figure 5B:
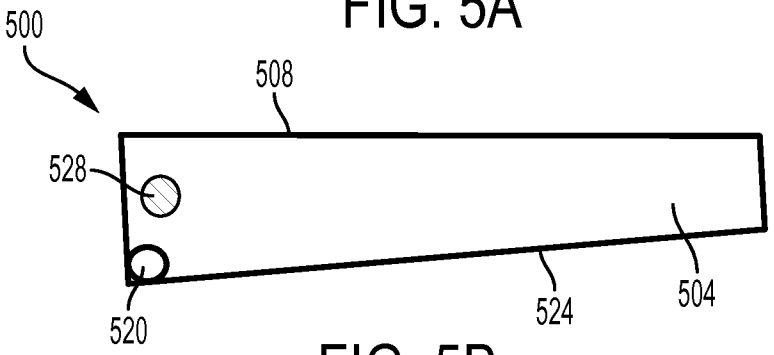
FIG. 5*b* shows a side view of the maintenance platform.

Purge channels 516 are included within the body 504 of the maintenance platform 500 and configured to provide a flow path for purged ink and other debris from the maintenance modules to a drain port 520 in a side of the maintenance platform 500. FIG. 5*b* shows a side view of the maintenance platform 500. The drain port 520 is disposed within the side of the maintenance platform 500. The drain port 520 is connected to the purge channels 516 to establish a continuous flow path that enables purged ink and other debris from the maintenance modules to flow through the purge channels 516 and to exit maintenance platform 500 from the drain port 520. In one embodiment, the drain port 520 drains the purged ink and other debris into purge cups 152 while the maintenance platforms are in their resting positions, shown in FIGS. 1*a* and 1*b*. In some embodiments, the body 504 of the maintenance platform 500 has a generally planar bottom surface 524 that is opposite the top surface 508 and has an angle relative to the top surface 508 such that the purged ink and other debris flows toward the drain port 520 due to gravitational forces on the purged ink and other debris. In one embodiment, the bottom surface 524 has an angle of about three degrees relative to the top surface 508

Figure 6A:
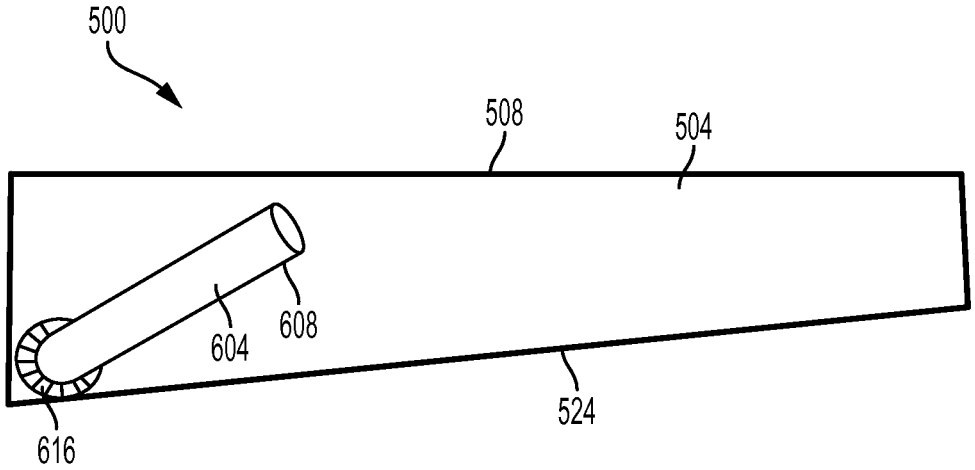
FIG. 6*a* shows a side view of the maintenance platform with a drain spout in a fill position.
Figure 6B:
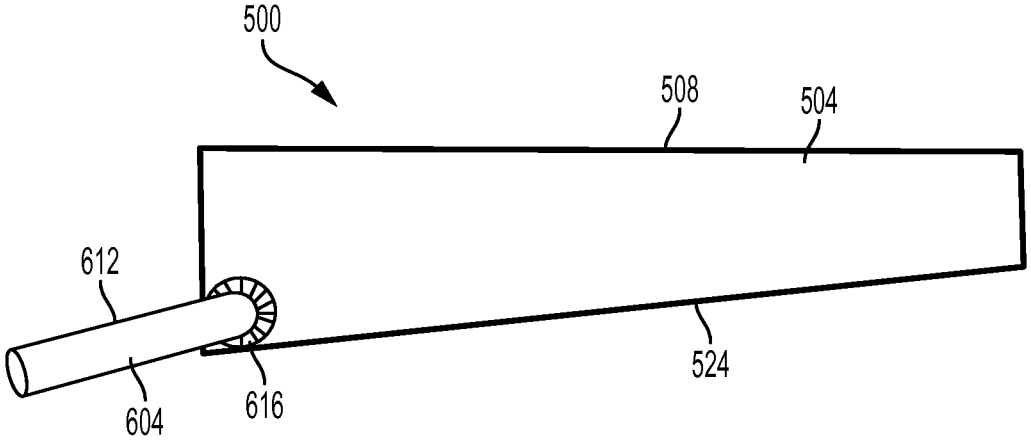
FIG. 6*b* shows a side view of the maintenance platform with the drain spout in a drain position.

In one embodiment, the maintenance platform 500 includes a drain spout 604 connected to the drain port 520, as shown in FIGS. 6*a* and 6*b*. The drain spout 604 is configured to move from a fill position 608 to a drain position 612. When the drain spout 604 is positioned at the fill position 608, purged ink and other debris is not allowed to drain. However, when the drain spout 604 is moved to the drain position 612, the purged ink and other debris is allowed to drain. In one embodiment, the drain spout drains the purged ink and other debris into the purge cups 152. In one embodiment, the maintenance platform 500 includes actuators 616 configured to pivot the drain spout between the fill position 608 and the drain position 612. In other embodiments, the frames 116 include passive actuators (not shown), such as a protrusion or ramp, that push the drain spouts 604 to the drain position 612 automatically as the maintenance platforms move to their resting positions.

The maintenance platform 500 includes at least one shaft 528 that extends through the body 504 in the cross-process direction CP. The shaft 528 engages with the frames 116 to mount to the maintenance platform 500 between the frames 116. In the embodiment of FIG. 1*a*, the shaft 528 engages with the tracks 140 to move along the tracks 140. In one embodiment, two shafts 528 engage with tracks 140, one at each end of the maintenance platform 500. In the embodiment of FIG. 1*b*, the shaft 528 engages with the actuator 148 to pivot between the resting position 132 and the operating position 136. In one embodiment, the maintenance platform 500 is also configured to move along the shaft 528 to translate the body 504 in the cross-process direction CP.

Figure 7A:
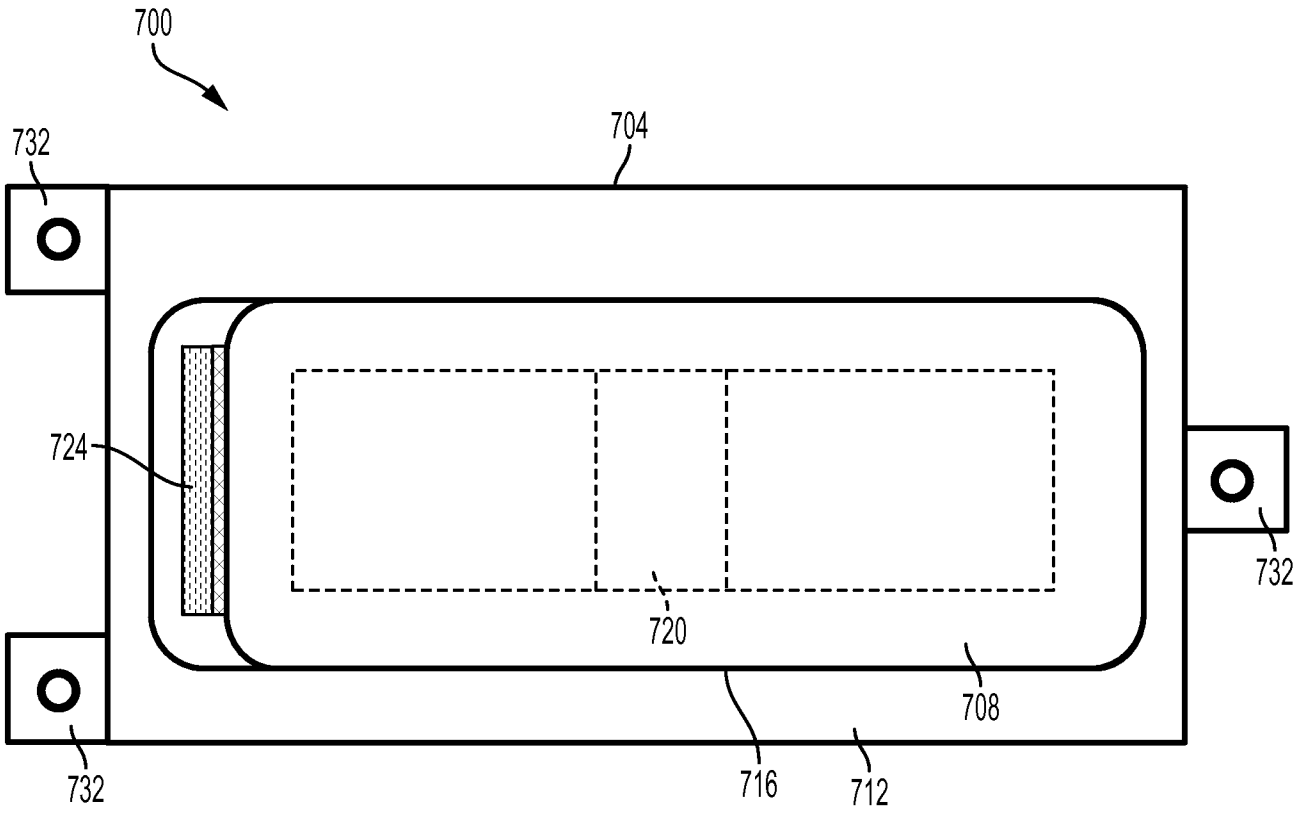
FIG. 7*a* shows a top view of a maintenance module.

FIG. 7*a* shows a top view of a maintenance module 700, which is one embodiment of a maintenance module for the sockets 512. The maintenance module 700 includes a body 704. A purge cup 708 is mounted into the body 704, such that the top of the purge cup 708 is roughly flush with a top surface 712 of the body 704. A seal 716 is mounted to the surface 712 and surrounds the purge cup 708. The seal 716 is configured to be pressed against a surface of a printhead to establish an airtight seal around the purge cup 708. The purge cup 708 has a drain port 720 configured to connect to the purge channels 516 when the maintenance modules 700 are mounted into a socket 512 of the maintenance platform 500. A wiper blade 724 is mounted to the surface 712 and configured to wipe against a surface of the printhead to clean debris from the printhead.

Figure 7B:
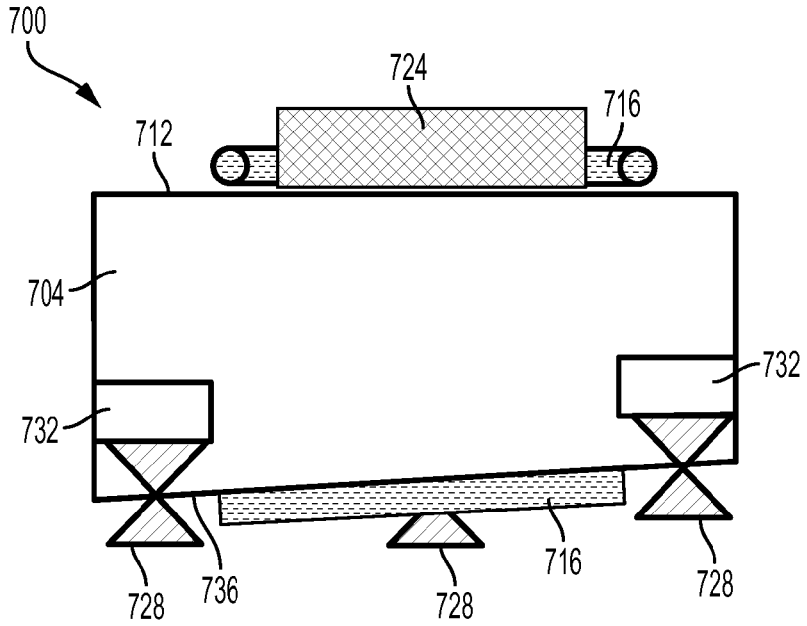
FIG. 7*b* shows a side view of the maintenance module.
Figure 7C:
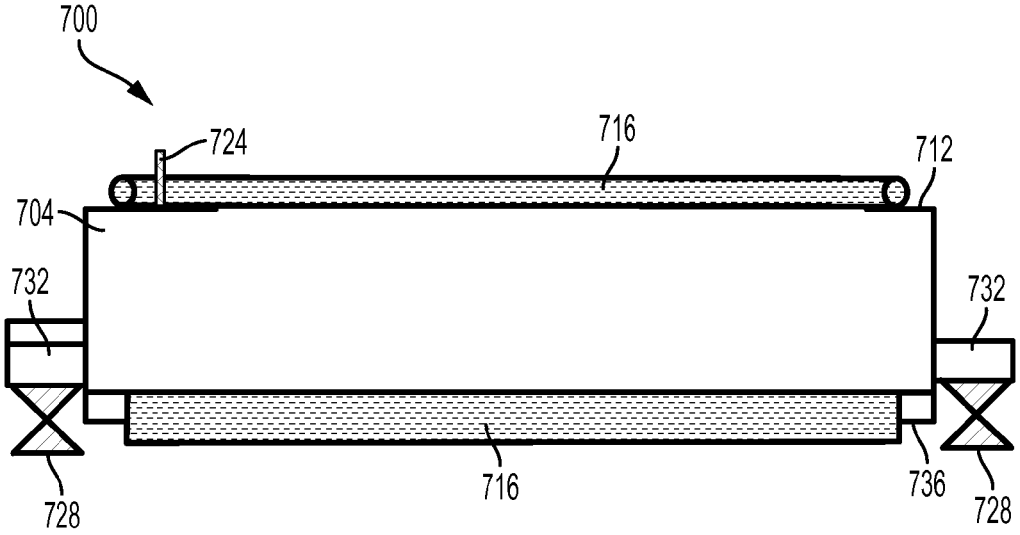
FIG. 7*c* shows a different side view of the maintenance module.
Figure 8:
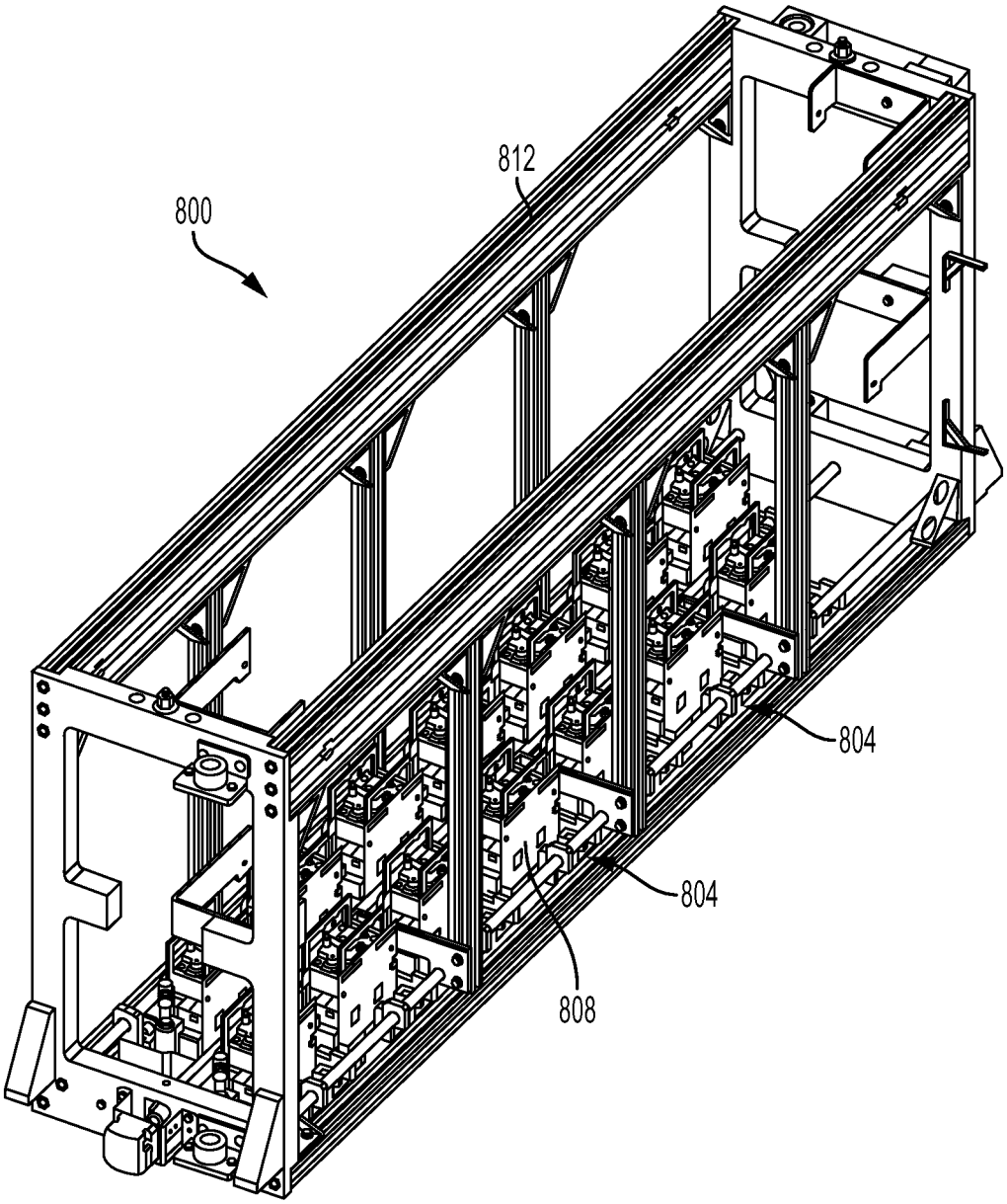
FIG. 8 PRIOR ART
FIG. 8 shows a prior art scalable printhead array.
Figure 9:
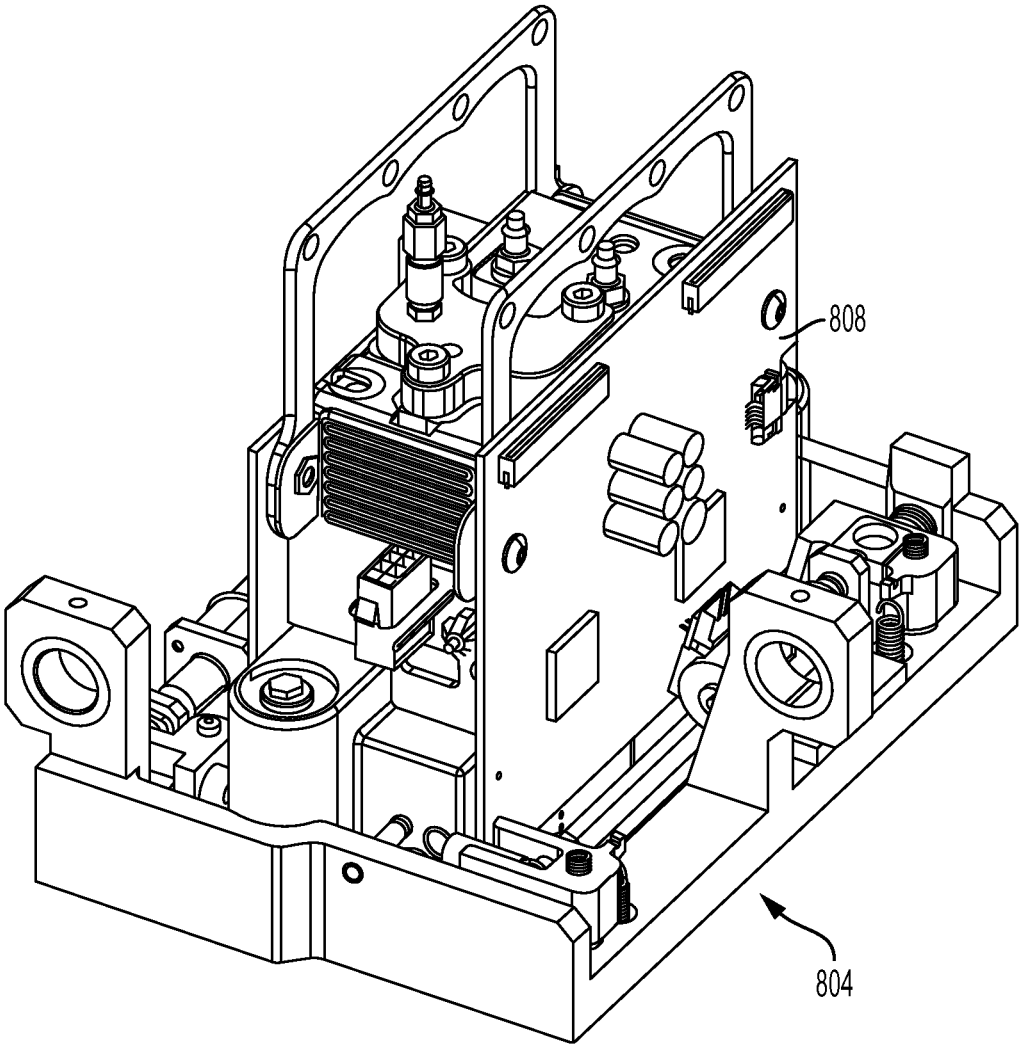
FIG. 9 PRIOR ART
FIG. 9 shows a prior art printhead assembly and printhead.

FIGS. 7*b* and 7*c* show side views of the maintenance module 700. In one embodiment, the maintenance module 700 further includes a plurality of springs 728 that connect to spring retainers 732. The springs 728 are configured to mount the maintenance module 700 to the maintenance platform 500 by connecting one end of the springs to the spring retainers 732 and the other end of the springs to the mounting holes 532 of the maintenance platform 500, shown in FIG. 5*a*. In one embodiment, shown in FIG. 7*b*, the body 704 has a bottom surface 736 opposite the top surface 712 that has an angle relative to the top surface 712 that matches the angle of the bottom surface 524 of the maintenance platform 500. In some embodiments, the seal 716 includes a lower portion mounted to the bottom surface 736 opposite the top surface 712 and configured to establish a seal between the maintenance module 700 and the socket 512. In some embodiments, the maintenance module 700 has a depth that depends upon to which row of the sockets 512 of the maintenance platform 500 it is mounted.

In some embodiments, when maintenance operations are performed, the printhead arrays 104, 108 are moved toward the maintenance platforms 124, 128, as shown in FIGS. 4*a* and 4*b*. In one embodiment, the maintenance platforms 124, 128 are equipped with a plurality of maintenance modules 700. The printhead arrays 104, 108 are lowered such that the seals 716 press against a surface of printheads of the printhead arrays 104, 108. The seals 716 establish an airtight seal around inkjets in the surface of the printheads, thereby capping the printheads. To purge the inkjets, the printhead arrays 104, 108 are quickly moved away from the maintenance platforms 124, 128. The seal around the inkjets cause the inkjets to purge ink into the purge cups 708 of the maintenance modules 700.

Next, the printhead arrays 104, 108 are moved toward the maintenance platforms such that the wiper blades 724 contact the surface of the printheads. In one embodiment, the wiper blades 724 are configured to rotate to a vertical position to make contact with the surface of the printheads. The maintenance platforms 124, 128 translate in the cross-process direction CP to wipe the wiper blades 724 against the surface of the printheads to clean debris from the surface. The purged ink and debris flow toward the drain port 720 of the purge cups 708 into purge channels of the maintenance platforms 124, 128.

It will be appreciated that variants of the above-disclosed and other features and functions, or alternatives thereof, may be desirably combined into many other different systems, applications or methods. Various presently unforeseen or unanticipated alternatives, modifications, variations, or improvements therein may be subsequently made by those skilled in the art, which are also intended to be encompassed by the following claims.

What is claimed is:

1. A printing system comprising:

a first printhead array having a plurality of printheads;

a pair of frames disposed in parallel and on opposite ends of the first printhead array;

a first maintenance platform mounted between the pair of frames and configured to move from a first position at a first side of the first printhead array to a second position opposite faces of the plurality of printheads of the first printhead array to enable the first maintenance platform to perform a maintenance operation on the plurality of printheads of the first printhead array when the first maintenance platform is at the second position, the first maintenance platform having a body having a first surface that faces the plurality of printheads of the first printhead array when the first maintenance platform is at the second position and a plurality of maintenance modules mounted to the first surface of the body and arranged to enable each maintenance module in the plurality of maintenance modules to align with a corresponding printhead of the first printhead array to perform a maintenance operation on the corresponding printhead of the first printhead array in response to the first maintenance platform being at the second position, the body of the first maintenance platform having a drain port in a surface of the body configured to drain debris from the plurality of maintenance modules, a plurality of drain channels within the body configured to guide the debris from the plurality of maintenance modules to the drain port, a spout extending from the drain port, the spout being configured to move between a first position and a second position, and a drain actuator configured to drain the debris selectively by moving the spout between the first position and the second position; and a first actuator configured to move the first maintenance platform between the first position and the second position.

2. The system of claim 1 further comprising:

a second printhead array having a plurality of printheads, the second printhead array being positioned in parallel to the first printhead array and opposite the first side of the first printhead array; and a second maintenance platform mounted between the pair of frames and configured to move from a first position at a first side of the second printhead array to a second position opposite faces of the plurality of printheads of the second printhead array to enable the second maintenance platform to perform a maintenance operation on the plurality of printheads of the second printhead array when the second maintenance platform is at the second position.

3. The system of claim 1, the pair of frames being further configured to extend from the first position at the first side of the first printhead array to the second position opposite the faces of the plurality of printheads in the first printhead array; and the pair of frames further includes:

a pair of tracks, the pair of tracks being mounted to the pair of frames and configured to engage with the first maintenance platform to guide the first maintenance platform along a path from the first position at the first side of the first printhead array to the second position; and the first actuator is configured to move the first maintenance platform along the pair of tracks between the first position and the second position.

4. The system of claim 1, the first actuator is further configured to:

pivot the first maintenance platform between the first position and the second position.

5. The system of claim 1 further comprising:

a second actuator configured to (i) move the first printhead array a first distance from the first maintenance platform before the first maintenance platform moves between the first position and the second position and to (ii) move the first printhead array a second distance toward the first maintenance platform after the first maintenance platform moves between the first position and the second position.

6. The system of claim 1, the first maintenance platform further comprising:

a plurality of sockets disposed in the first surface of the body and configured to receive the plurality maintenance modules, the plurality of sockets being arranged in the first surface of the body to enable each socket in the plurality of sockets to align with the corresponding printhead of the first printhead array in response to the first maintenance platform being at the second position.

7. The system of claim 1, the first maintenance platform further comprising:

a shaft configured to engage with each of the pair of frames, the body being mounted about the shaft.

8. The system of claim 7, the body of the first maintenance platform being further configured to:

move along the shaft to perform the maintenance operation on the first printhead array.

9. The system of claim 1, the body of the first maintenance platform further comprising:

a second surface that is opposite the first surface and oriented at an angle relative to the first surface to enable gravitational force to move debris to the drain port.

10. The system of claim 9, wherein the second surface is at angle of about three degrees relative to the first surface.

11. The system of claim 1, at least one maintenance module of the plurality of maintenance modules comprising:

a wiper blade configured to wipe against the face of the printhead of the first printhead array opposite the at least one maintenance module when the first maintenance platform is at the second position.

12. The system of claim 1, the at least one maintenance module of the plurality of maintenance modules further comprising:

a receptacle configured to receive purged material from the printhead of the first printhead array opposite the at least one maintenance module when the first maintenance platform is at the second position.

13. The system of claim 1, at least one maintenance module of the plurality of maintenance modules comprising:

a seal configured to press against the face of the printhead of the first printhead array opposite the at least one maintenance module when the first maintenance platform is at the second position and to isolate from the other printheads in the first printhead array the face of the printhead in the first printhead array opposite the at least one maintenance module when the first maintenance module when the first maintenance platform is at the second position.

14. The system of claim 1, at least one maintenance module of the plurality of maintenance modules comprising:

a plurality of retainers configured to engage with a plurality of springs to mount the at least one maintenance module of the plurality of maintenance modules to the first surface of the body.

* * * * *